US008875729B1

(12) United States Patent
Bramble et al.

(10) Patent No.: US 8,875,729 B1
(45) Date of Patent: Nov. 4, 2014

(54) SUMP PUMP APPARATUS AND METHOD

(75) Inventors: Curtis Bramble, Kansas City, MO (US); Otto W. Fleck, Kansas City, MO (US); Lowell Hickman, Riverside, MO (US)

(73) Assignee: Dry Basement, Inc., Kansas City, MO (US)

( * ) Notice: Subject to any disclaimer, the term of this patent is extended or adjusted under 35 U.S.C. 154(b) by 876 days.

(21) Appl. No.: 12/987,756

(22) Filed: Jan. 10, 2011

(51) Int. Cl.
*F16L 5/00* (2006.01)

(52) U.S. Cl.
USPC ..... 137/362; 417/40; 137/363; 137/565.17

(58) Field of Classification Search
CPC ..... E03F 5/042; E03F 5/22; F04D 13/08
USPC ..... 137/363, 565.17, 362; 417/2, 3, 4, 5, 6, 417/36, 40, 41, 423.3; 220/484
See application file for complete search history.

(56) References Cited

U.S. PATENT DOCUMENTS 4,057,366 A * 11/1977 Niemann ..... 417/234
4,422,829 A * 12/1983 Buchanan ..... 417/40
4,456,432 A * 6/1984 Mannino ..... 417/2
6,308,924 B1 * 10/2001 Janesky ..... 248/346.01
2005/0281679 A1 * 12/2005 Niedermeyer ..... 417/36
2006/0093492 A1 * 5/2006 Janesky ..... 417/366
2007/0047382 A1 * 3/2007 McCurdy et al. ..... 366/153.1
2009/0183785 A1 * 7/2009 Cole et al. ..... 137/363

OTHER PUBLICATIONS

TripleSafe Sump Pump System, Basement Systems—Responsible Waterproofing, P/N #11370, 2006, 1 page, Dry Basement, Inc., Kansas City, MO.
SuperSump, Premier Sump Pump System, Basement Systems—Responsible Waterproofing, P/N #11300, 2006, 1 page, Dry Basement, Inc., Kansas City, MO.
Anderson, Murray, How Sump Pumps Work, Howstuffworks "How Sump Pumps Work", http://home.howstuffworks.com/home-improvement/plumbing/sump-pump.htm/printable, printed Dec. 21, 2010, 5 pages.

* cited by examiner

*Primary Examiner* — Kevin Murphy
(74) *Attorney, Agent, or Firm* — Erise IP, P.A.

(57) ABSTRACT

A sump pump assembly broadly comprises a square or rectangular-shaped basin, a first shelf fixedly position in a lower end of the basin, a lid for securing to an upper end of the basin, the lid having a transparent window for viewing a water level in the basin, a light mounted within the basin for assisting in viewing the water level, a first pump positioned on a floor of the basin, a second pump positioned on the first shelf, and an alarm for notifying a building owner when the first pump ceases to operate but prior to operation of the second pump. Alternative embodiments comprise a battery-powered third pump, a battery for powering the third pump, and a mount for mounting the battery inside the basin.

19 Claims, 8 Drawing Sheets

SUMP PUMP APPARATUS AND METHOD

BACKGROUND OF THE INVENTION

1. Field of the Invention

The present inventions relates to sump pump assemblies and methods for installing a sump pump that insure an entire use of the wear life of the installed pumps, that allow for viewing of a water level in the assembly's basin, that prevent movement of the pumps during use, and that allow for installation of the assembly in a finished basement.

2. Description of the Related Art

Sump pump assemblies and systems are commonly used to collect water from a lowermost elevation in a building, such as under and around the building's basement floor slab, and discharge the water to a location external to the building's foundation or to a sewer system. The sump pump assembly is traditionally buried in a sump pit that is built into the basement floor or building crawlspace. Water or other fluid and waste is collected within a sump pump basin. A submersible pump housed within the basin pumps the water to the discharge line 56 in fluid communication with the pump. The discharge line 56 then transports the water to the external location or sewer system.

Some sump pump assemblies include two or even three pumps. In a two-pump system, the second pump is installed for instances when the water volume flowing to the basin is so large that a first pump cannot pump and discharge the water sufficiently quickly. In other words, more water is entering the basin than is being pumped out of the basin, such that the basin overflows, which results in water damage to the building's foundation and basement floor.

In the two-pump system, the second pump is sometimes installed in the basin at an elevation that is higher than the first pump. This is because the pumps are activated based on the water level in the basin, either through a float activation or a pressure sensitive activation. The second pump will not activate until the water level rises high enough in the basin to activate a float or pressure sensitive sensor. Thus, in the two-pump system, the second pump is not activated until the water level rises due to the first pump not being able to keep up with the volume of water entering the basin.

The two-pump system as installed in the prior art has two significant disadvantages, however. First, the second pump is positioned at an elevation higher than the first pump by simply setting the second pump on one or more risers that are not fixed or secured within the basin. Although the pump itself is fairly heavy (it commonly has a cast iron body), the force and volume of the water in the basin still produces movement of the unsecured risers. If the movement of the risers then results in movement of the pump, this can adversely affect proper operation of the pump. In particular, the pump's float may become lodged against the basin wall, against the first pump, or against other components housed within the basin, or the pressure sensor may be obstructed so that it does not properly function. The pump will then cease to activate as the water rises.

Accordingly, there is a need for a sump pump basin designed to elevate the second pump within the basin while still maintaining the second pump in a fixed location relative to the basin walls and other structure within the basin.

A second disadvantage of the prior art two-pump system occurs when the first pump ceases to operate due to common wear and tear or breaking of a part. The sump pump assemblies of the prior art are not easily accessible, and most building owners do not regularly check that the pumps are operating properly. The building owners then do not realize that the first pump has ceased operating until there is a large volume of water entering the basin that cannot be sufficiently discharged using only the second pump. As can be appreciated, the building owner's realization that the first pump ceased operating often comes too late to prevent water damage.

To address the breakdown of the first pump, some sump pump installers suggest replacing the first pump prior to its breakdown at end of life. Although this insures that the pump will (for the vast majority of circumstances) always operate, this also results in the first pump being replaced sometimes well before its end of life. For example, many sump pumps may have a 15-20 year lifespan. However, because of the significant damage that can occur if the first pump unknowingly ceases operating, some building owners will choose to replace the first pump after as little as 5-6 years of wear. This results in the vast majority of first pumps in a two-pump system not receiving almost 10-15 years of otherwise viable use.

Accordingly, there is a need for a sump pump assembly that allows for the building owner to obtain the entire wear life of the first pump without incurring the risk of the first pump unknowingly ceasing operating.

In a three-pump system, the third pump is commonly a battery-powered pump. In the two-pump system, both the pumps are AC powered by the building's electrical system. However, if the electricity is cut off, then the first and second pumps will not operate. Thus, some building owners choose to install the third pump that is DC battery powered for use in those instances where power to the first and second pumps is cut off. The battery is then positioned externally to the basin, often being located on the basement floor.

Accordingly, there is a need for a basin configured to house and mount the battery for a battery-powered pump.

As noted above, a disadvantage of prior art sump pump assemblies is that they are not easily accessible. The basin for the sump pump commonly includes a lid that is secured to the basin via a plurality of screws or bolts. To access an interior of the basin or otherwise see the water level in the basin, the building owner must unscrew the screws securing the lid. In instances where the building owner simply wants to view the water level in the basin, the removal of the lid is a time consuming task.

Accordingly, there is a need for a sump pump assembly, and in particular, a basin, that allows viewing of the water level in the basin without removal of the lid.

SUMMARY OF THE INVENTION

Embodiments of the present invention solve the above-mentioned problems and provide a distinct advance in the art of sump pump assemblies. More particularly, embodiments of the present invention provide a sump pump assembly that overcomes many disadvantages of prior art sump pump assemblies. The present sump pump assembly insures use of the entire wear life of the pumps without risking water damage to a basement due to a non-operating pump. The present sump pump assembly also houses all components of the assembly in a basin so as to present an aesthetically appealing assembly that can be installed in a finished basement. Further, the present sump pump assembly prevents the pumps from becoming dislodged or moving, which can adversely affect operation. Finally, the sump pump assembly provides a selectively illuminated basin interior for viewing of a water level of the basin without removal of a lid of the basin.

The sump pump assembly of embodiments of the present invention comprises a basin having first, second, third, and fourth walls and a floor so as to present an interior and a generally square or rectangular perimeter shape. The basin has a lower end contained by the floor and an open upper end and presents a lower elevation. The basin further includes a first generally horizontal interior shelf spaced above the basin floor, and particularly above the lower elevation, and fixedly positioned within the basin interior. The first shelf presents a midrange elevation in the basin, such that the midrange elevation is above the lower elevation.

The sump pump assembly further includes a lid removably secured to the open upper end of the basin. The lid has a transparent window for viewing a water level in the basin without removal of the lid from the upper end of the basin. Additionally, a selectively-powered light is mounted within the basin, and preferably within the lid, for illuminating the interior of the basin. An input for selectively actuating the light is provided external to the basin and preferably in the basin lid.

A first submersible pump is positioned at the lower elevation in the basin, and in some embodiments, the lower elevation is the floor of the basin. A second submersible pump is positioned on the first shelf at the midrange elevation of the basin. The second pump is associated with an activation elevation at which the second pump is activated due to the water level in the basin being at an elevation that activates the second pump, i.e., the activation elevation.

The sump pump assembly further includes an alarm having a sensor positioned within the basin and below the activation elevation of the second pump, such that the alarm is activated upon the water level in the basin rising to a level below the activation elevation for the second pump.

In an alternative embodiment of the present invention, the sump pump assembly further includes a second shelf presenting an upper elevation that is above the lower and midrange elevations, a third, battery-operated pump mounted at the upper elevation, a battery for powering the third pump, and a mount for mounting the battery. In embodiments of the present invention, the mount comprises the second shelf and at least one longitudinal rib extending inwardly within the basin.

The sump pump assembly of the present invention presents a sump pump that can be installed in a finished basement. Unlike prior art sump pumps where a discharge pipe extends from the lid of the basin and where the battery is external to the basin, embodiments of the present invention house all components within the basin. The building owner can then cover the basin lid with flooring or carpet so as to obtain a finished, aesthetically appealing basement area. When the building owner desires to view a water level in the basin, the internal light can be illuminated. Additionally, the present assembly allows for use of the entire life of the first and second pumps and maintains proper placement and positioning of the pumps during use.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
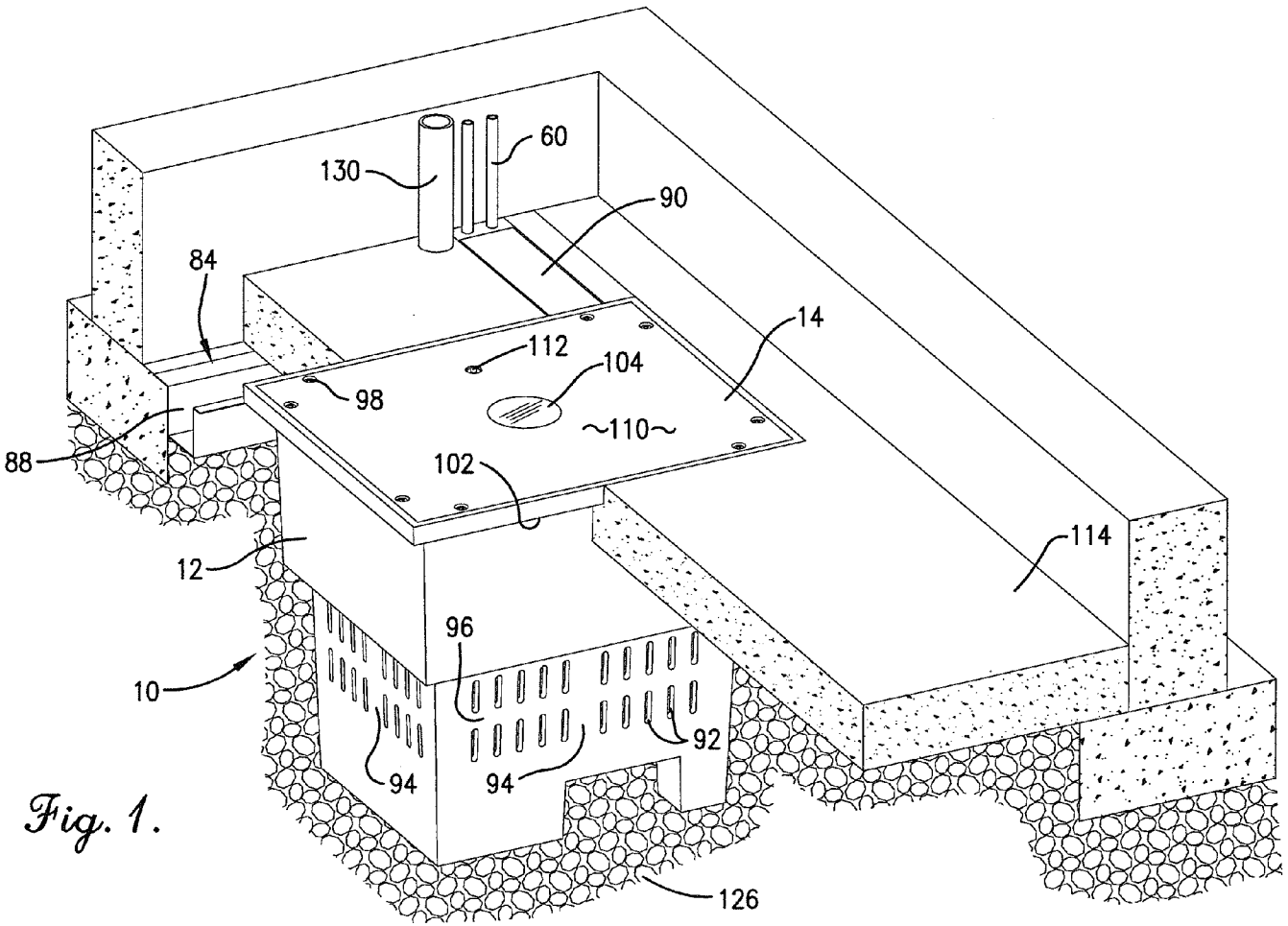
FIG. 1 is a perspective view of a sump pump assembly of embodiments of the present invention and particularly illustrating the assembly installed in a basement.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Referring now to FIGS. 1-5, in a first embodiment of the present invention, a sump pump assembly 10 and method broadly comprises a basin 12, a lid 14 removably secured to the basin 12, a light 16 mounted in the basin 12, a first submersible pump 18 positioned at a lower elevation 20 in the basin 12, a second submersible pump 22 positioned at a midrange elevation 24 in the basin 12, and an alarm 26 positioned within the basin 12 such that the alarm 26 is activated upon the water level in the basin 12 rising to a particular elevation.

In a second embodiment of the present invention illustrated in FIGS. 1-2 and 6-8, the sump pump assembly 10 and method broadly comprises the basin 12, the lid 14 removably secured to the basin 12, the light 16 mounted in the basin 12, the first submersible pump 18 positioned at the lower elevation 20 in the basin 12, the second submersible pump 22 positioned at the midrange elevation 24 in the basin 12, a third, battery-powered submersible pump 28 positioned at an upper elevation 30 in the basin 12, a battery 32 for powering the third pump 28, a mount 34 for removably mounting the battery 32 in the basin 12, and an alarm 26 positioned within the basin 12 such that the alarm 26 is activated upon the water level in the basin 12 rising to a particular elevation.

Figure 3:
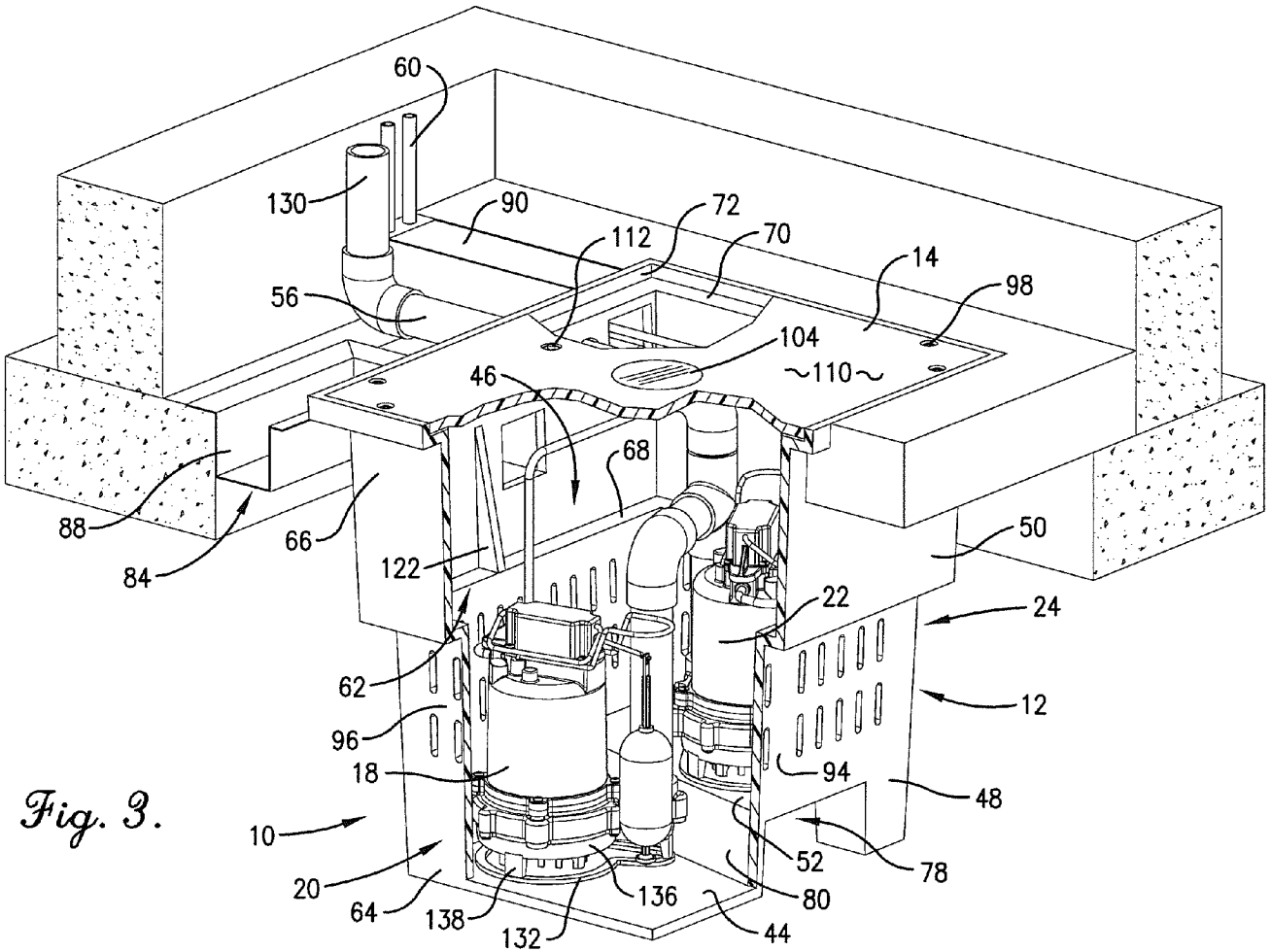
FIG. 3 is a perspective view of the sump pump assembly of FIG. 1 with a portion of the sump pump basin removed to illustrate internal components of the assembly.
Figure 4:
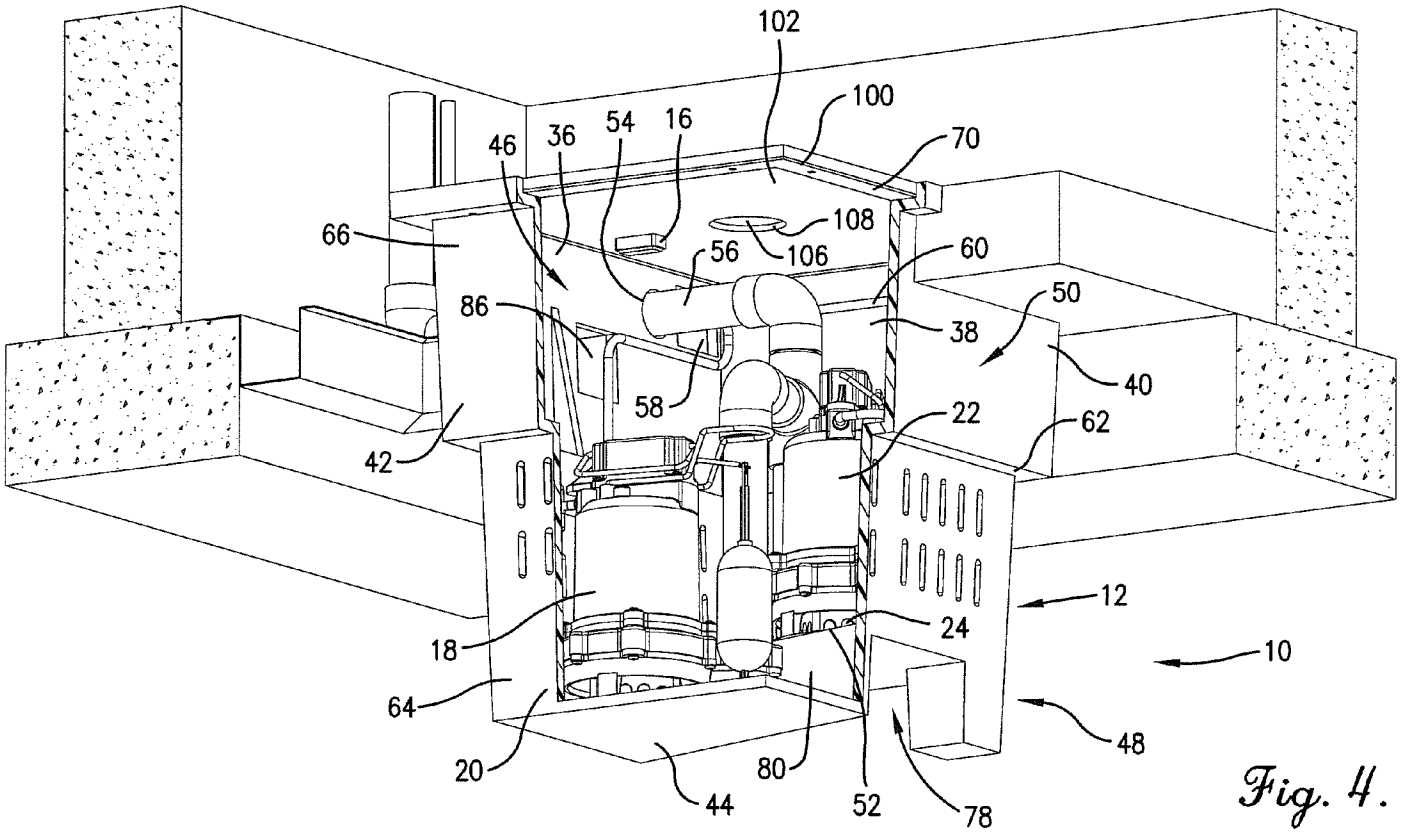
FIG. 4 is a upward facing perspective view of the assembly of FIG. 3.
Figure 5:
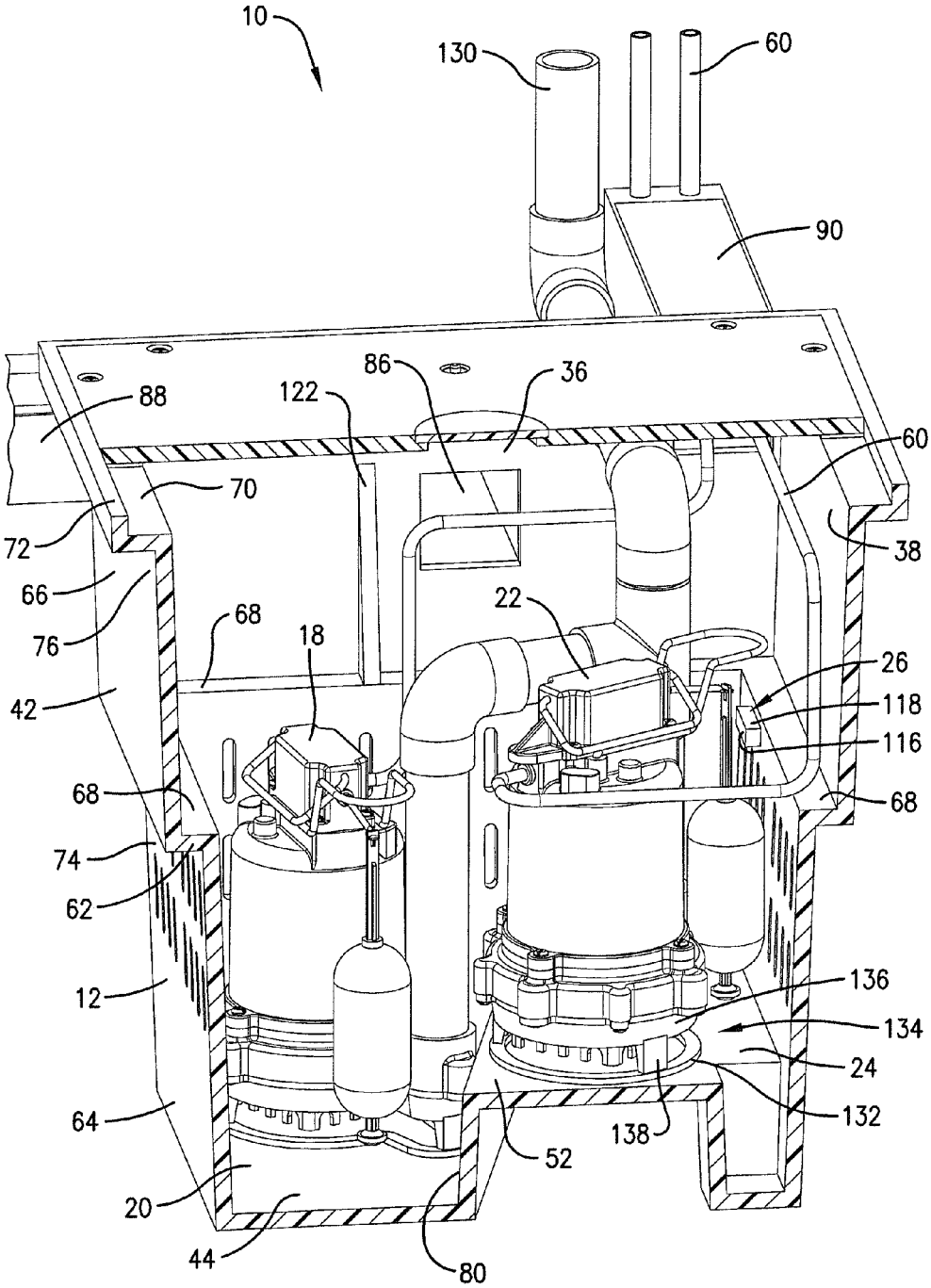
FIG. 5 is a perspective view of a first embodiment of the sump pump assembly of the present invention with a portion of the basin removed.

Referring to FIGS. 3-5, the first embodiment of the present invention is illustrated. The basin 12 of embodiments of the present invention comprises first, second, third, and fourth walls 36,38,40,42 (hereinafter collectively referenced as "36-42") and a floor 44 so as to form an interior 46 of the basin 12 for housing various components of the sump pump assembly 10. The basin 12 presents a lower end 48 contained by the floor 44 and an open upper end 50. The walls 36-42 intersect to form a generally square or rectangular-shaped perimeter at the upper end 50 of the basin 12 or to otherwise form a basin 12 having a square or rectangular-shaped horizontal cross section. The basin 12 further includes a first generally horizontal interior shelf 52 spaced above the basin floor 44 and fixedly positioned within the basin interior 46, a first opening 54 in one of the basin walls 36-42 for receipt of a discharge line 56 therethrough, and a second opening 58 in one of the basin walls 36-42 for receipt of wiring 60 therethrough.

The above description is provided to identify each of the walls 36-42 separately. However, it should be appreciated that the basin 12 may be made of a molded polymer, such that the walls 36-42 and floor 44 are integral. In particular, the basin 12 may be formed through injection molding or other suitable process that results in a generally unitary structure.

In embodiments of the present invention, the walls 36-42 intersect each other at an approximately 90° angle at the upper end 50 of the basin 12. As illustrated in FIG. 3, each wall 36-42 includes a first externally extending step 62 located generally intermediate a height of the wall 36-42 and dividing each wall 36-42 into lower and upper ends 64,66. When the walls 36-42 are joined to form the basin 12, the first externally extending step 62 forms a second generally horizontal interior shelf 68 for mounting the battery 32 of the second embodiment of the present invention, which is discussed in more detail below. The second shelf 68 presents the upper elevation 30.

Each of the walls 36-42 also includes a second externally extending step 70 at the upper end 66 of the wall, such that when the walls 36-42 are joined to form the basin 12, the basin 12 includes a lip 72. (For ease of reference, each of the lower and upper ends 64,66 of the walls 36-42, the first externally extending step 62, and the second externally extending step 70 are identified by the same reference numeral).

Referring now to the lower end 64 of each wall 36-42, a height of the lower end 64 is approximately 7-17 inches and more preferably approximately 12 inches. The lower end 64 of each wall 36-42 is angled gradually inwardly to create an approximate 2° draft from a top 74 of the lower end 64 of the wall 36-42 to the floor 44. A width of the top 74 of each lower end 64 of the wall 36-42 is approximately 11-17 inches and more preferably approximately 14 inches.

Referring now to the upper end 66 of each wall 36-42, a height of the upper end 66 is approximately 14-24 inches and more preferably approximately 19 inches. The upper end 66 of each wall 36-42 is angled gradually inwardly to create an approximate 2° draft from a top 76 of the upper end 66 of the wall 36-42 to the first externally extending step 62.

The second and fourth walls 38,42 are slightly wider than the first and third walls 36,40. A width of the first and third walls 36,40 at their upper end 66 (excluding the lip 72 formed from the externally extending step 70) is approximately 14-21 inches and more preferably approximately 17.25 inches. A width of the second and fourth walls 38,42 at their upper end 66 (excluding the lip 72 formed from the externally extending step 70) is approximately 18-24 inches and more preferably approximately 21 inches. A width of the externally extending step 70 is approximately 1-2 inches and more preferably approximately 1.25 inches.

It should be appreciated that the above measurements for the various dimensions of the basin 12 are for illustrative purposes only, and the dimensions for the basin 12 may be smaller or larger depending on a size of the components installed and/or whether the basin 12 is housing two or three pumps.

The basin floor 44 is substantially flat and presents the lower elevation 20 in the basin 12. However, in embodiments of the present invention illustrated in the Figures, the basin floor 44 does not extend to cover an entire horizontal area formed by the lower end 64 of the basin walls 36-42. In particular, the first generally horizontal interior shelf 52 is fixedly positioned in the lower end 48 of the basin interior 46, as best illustrated in FIGS. 3 and 5. In such an embodiment the first shelf 52 is integrally formed with the basin walls 36-42 and floor 44. A horizontal area of the shelf 52 is approximately the same or less than a horizontal area of the floor 44, although the first shelf's area can be smaller or larger to the extent the first pump 18 can be positioned on the floor 44 and the second pump 22 can be positioned on the first shelf 52.

The first generally horizontal interior shelf 52 is spaced above the lower elevation 20 comprising the basin floor 44 preferably a vertical distance of approximately 1-6 inches, more preferably approximately 2-4 inches, and most preferably approximately 3.5 inches. As discussed in more detail below, the first shelf 52 is sized to receive the second pump 22.

So as to form the first shelf 52 while not unduly wasting materials, the second, third, and fourth walls 38,40,42 are stepped to present external deadspace 78. This is desirable so as to prevent an area underneath the first shelf 52 from receiving water thereunder, as it may be difficult for the first pump 18 to collect water from the area. As illustrated in FIG. 3, a short retaining wall 80 extends downward from the first shelf 52 and to the floor 44. This retaining wall 80 closes off the area under the first shelf 52 (i.e., the external deadspace 78) so as to prevent water from flowing underneath the first shelf 52.

In alternative embodiments of the present invention, the first shelf 52 is not integrally formed with the basin walls 36-42 and floor 44 but rather is coupled or otherwise attached to one or more of the basin walls 36-42 and/or basin floor 44. For example, the first shelf 52 could be a separate component that is fixedly secured within the basin interior 46 via screws, bolts, or other fasteners (not shown). Thus, it is to be appreciated that the first shelf 52 being fixedly positioned within the basin interior 46 refers to the first shelf 52 being integrally formed with the basin floor 44 and walls 36-42 or to the first shelf 52 being fixedly coupled with the basin floor 44 and/or walls 36-42 so as to not be movable during use of the sump pump assembly 10.

In even further alternative embodiments of the present invention, the walls 36-42 do not include the first externally extending step 62 to form the second generally horizontal interior shelf 68. For example, the walls 36-42 could be substantially parallel, or, alternatively, the walls 36-42 could include an inwardly angled draft without the step 62.

In embodiments of the present invention, the walls 36-42 may include markers (not shown) for indicating where the first and second openings 54,58 should be formed. In particular, up to three openings or holes may be formed in the basin 12. The first opening 54 may be formed, preferably in the first wall 36, for receipt of the discharge line 56 therethrough. The second opening 58 may be formed, preferably in the first wall 36 and proximate the first opening 54, for receipt of wiring 60 therethrough.

In embodiments of the invention that are in fluid communication with a water diverting system 84 that diverts water to the sump pump assembly 10 from other areas around the building's foundation, a third opening 86 may be formed for fluid communication with an intake line 88 of the water diverting system 84. In such an instance, the third opening 86 would be formed in the wall 36-42 closest to the intake line 88. An exemplary water diverting system 84 is disclosed in U.S. patent application Ser. No. 12/980,601, filed Dec. 29, 2010, which is assigned to the assignee of the present application. The '601 Application is hereby incorporated by reference into the present application in its entirety.

Rather than forming the openings 54,58,86 during manufacture of the basin 12, embodiments of the present invention include markers (not shown) for identifying preferred locations for the openings 54,58,86. An installer of the sump pump assembly 10 can then manually form the openings 54,58,86 onsite. This insures that the openings 54,58,86 align properly with the various components, such as the discharge line 56, a wire chase 90 for containing the wiring 60, and the intake line 88 for the water diverting system 84. The openings 54,58,86 will be sized to accommodate the components; however, a standard-sized opening is circular and approximately 2 inches in diameter, although differently shaped and sized openings 54,58,86 may be formed.

A plurality of perforations or slots 92 are formed in the lower end 48 of the basin 12. The perforations 92 allow water to enter the basin 12, where it is then collected by the pump(s). Referring to FIG. 1 and, each perforation 92 is approximately 2.25 inches in height and approximately ⅜ inch in width, although differently sized perforations 92 could be formed. The perforations 92 begin approximately 2 inches horizontally inward from an edge of each wall 36-42 to insure the structural integrity of the basin 12. The perforations 92 are horizontally spaced approximately 0.5-0.75 inch. An approximate 2 inch center panel 94 is left with no perforations 92 to insure the structural integrity of the basin 12. There are preferably at least two rows of perforations 92, although there may be more or less depending on the desired flow rate of water into the basin 12. There is an approximate 1 inch margin 96 between each row of perforations 92. Preferably, the lowermost row begins at least 2-6 inches and more preferably approximately 4-4.5 inches above the basin floor 44 so as to act as a silt separator so that silt will not enter the basin 12.

Referring now to FIGS. 1, 3, and 4, the lid 14 is illustrated secured to the open upper end 50 of the basin 12. The lid 14 preferably extends around the lip 72 of the basin 12 and is secured to the basin 12 by screws, bolts, or other fasteners 98 secured through the externally extending step 70. A gasket 100 may be interposed between the lip 72 of the basin 12 and a bottom 102 of the lid 14 so as to assist in preventing dampness and radon from escaping through the lid 14.

The lid 14 preferably includes a transparent window 104 for viewing a water level in the basin 12 without removal of the lid 14 from the upper end 50 of the basin 12. The window 104 is formed of a transparent polycarbonate resin, such as Lexan®, or other suitable material and is generally circular with an approximate 4 inch diameter, although a differently-shaped and sized window 104 may be employed.

Referring to FIG. 4, an opening 106 is formed in the lid 14 for receipt of the window 104. The opening 106 includes a recessed lip 108 of approximately ¼ to ⅜ inch. The window 104 will sit on the lip 108 so as to be flush with a top 110 of the lid 14.

The light 16 is mounted so as to illuminate the interior 46 of the basin 12. In preferred embodiments of the present invention, the light 16 is mounted within the basin 12, and in even further preferred embodiments of the present invention, the light 16 is mounted on or otherwise countersunk in the bottom 102 of the lid 14. The light 16 is coupled with an input 112 that is external to the basin 12 for actuation by a building owner. Preferably, the input 112 is push button with a flexible top and is flush with the top 110 of the lid 14. The light 16 is preferably battery operated and comprises at least one LED that is sufficiently bright that the building owner can determine the water level of the basin 12 upon actuation of the input 112 and powering of the light 16. The light 16 is positioned approximately 2-5 inches and more preferably approximately 3 inches from the window 104.

As noted above, the first embodiment of the sump pump assembly 10 employs two pumps 18,22, while the second embodiment employs three pumps 18,22,28. The pumps 18,22,28 used in the sump pump assembly 10 of the present invention are conventional float-activated or pressure-activated submersible AC sump pumps. As is known in the art, the pumps 18,22,28 are operable to collect the water and discharge it to the discharge line 56. The first and second pumps 18,22 are powered by the building's electrical system and therefore, access an external outlet in the building (not shown). The wiring 60 for the first and second pumps 18,22 extends through the second opening 58, discussed above, and to the wire chase 90. As discussed below, the wire chase 90 is preferably mounted within a basement floor slab 114 so as to be generally flush with the floor. In embodiments of the present invention, two dedicated electrical outlets are installed for each of the first and second pumps 18,22.

In both embodiments, the first pump 18 is positioned at the lower elevation 20, which preferably comprises the basin floor 44 and as best illustrated in FIG. 3. However, it is contemplated that the lower elevation 20 may be higher than the basin floor 44, such as if a third shelf (not shown) was installed or formed in the basin 12 to receive thereon the first pump 18 at the lower elevation 20. In such a case, the third shelf would comprise the lower elevation 20. The present invention contemplates, however, that the lower elevation 20 is vertically below the height of the first shelf 52.

The second pump 22 is positioned on the first shelf 52, which is at the midrange elevation 24 in the basin 12. As noted above, the first shelf 52 comprising the midrange elevation 24 is above the lower elevation 20 comprising the fixture (i.e., the floor 44 or the third shelf) on which the first pump 18 is positioned, such that the midrange elevation 24 is above the lower elevation 20. It is to be understood that use of the term "midrange elevation" refers to an elevation between the lower elevation 20 and the upper elevation 30 and does not necessarily indicate an elevation that is in the middle of a height of the basin 12.

The second pump 22 is further associated with an activation elevation. The activation elevation is the vertical height to which the water level in the basin 12 must rise to activate the second pump 22. As can be appreciated, the activation elevation may vary depending on the make or model of the second pump 22, including whether the second pump 22 is a float-activated or pressure-activated pump. However, regardless of the type of second pump 22 employed, the second pump 22, once positioned on the first shelf 52 of the basin 12, will activate once the water level reaches a certain height, which is referred to herein as the activation elevation for the second pump 22.

The final primary component of the first embodiment of the sump pump assembly 10 of the present invention is the alarm 26. The alarm 26 includes a sensor 116 that detects the water level in the basin 12, such as a pressure-sensitive sensor or a sensor to sense the mechanical activation of the second pump's float (assuming the second pump 22 is float-activated). The sensor 116 may be housed within a housing 118 of the alarm 26 or may be operably coupled with the housing 118 of the alarm 26. The sensor 116 is positioned within the basin 12 and below the activation elevation of the second pump 22, such that the alarm 26 is activated upon the water level in the basin 12 rising to a level below the activation elevation for the second pump 22. More particularly, the alarm 26 activates when the water level rises above an activation level for the first pump 18 and below the activation level for the second pump 22. In embodiments of the present invention, the sensor 116 is positioned approximately 0.25-5 inches above the activation elevation for the first pump 18, more preferably within 3 inches above the activation elevation for the first pump 18, and most preferably within 0.75 inches above the activation elevation for the first pump 18. Thus, the alarm 26 will activate very shortly after the water level rises above the activation elevation for the first pump 18.

Figure 6:
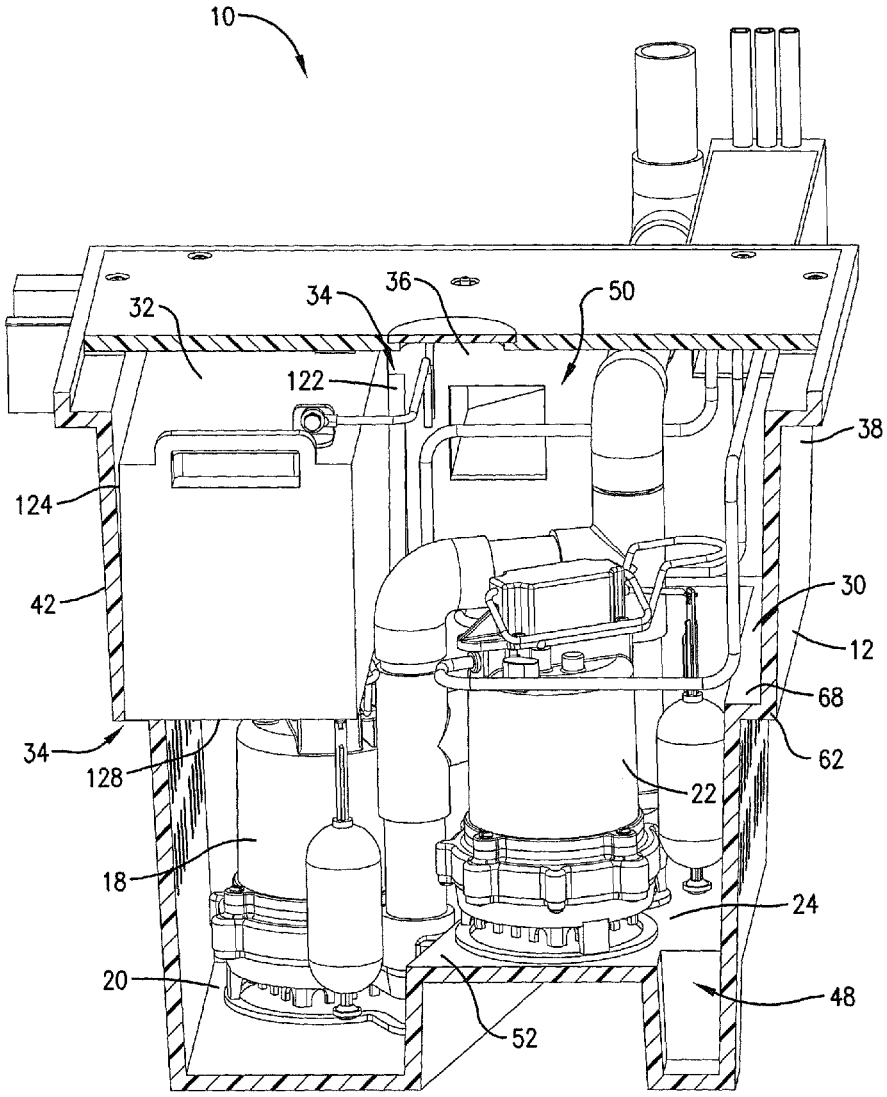
FIG. 6 is a perspective view of a second embodiment of the sump pump assembly of the present invention with a portion of the basin removed and illustrating a battery housed in the basin.
Figure 7:
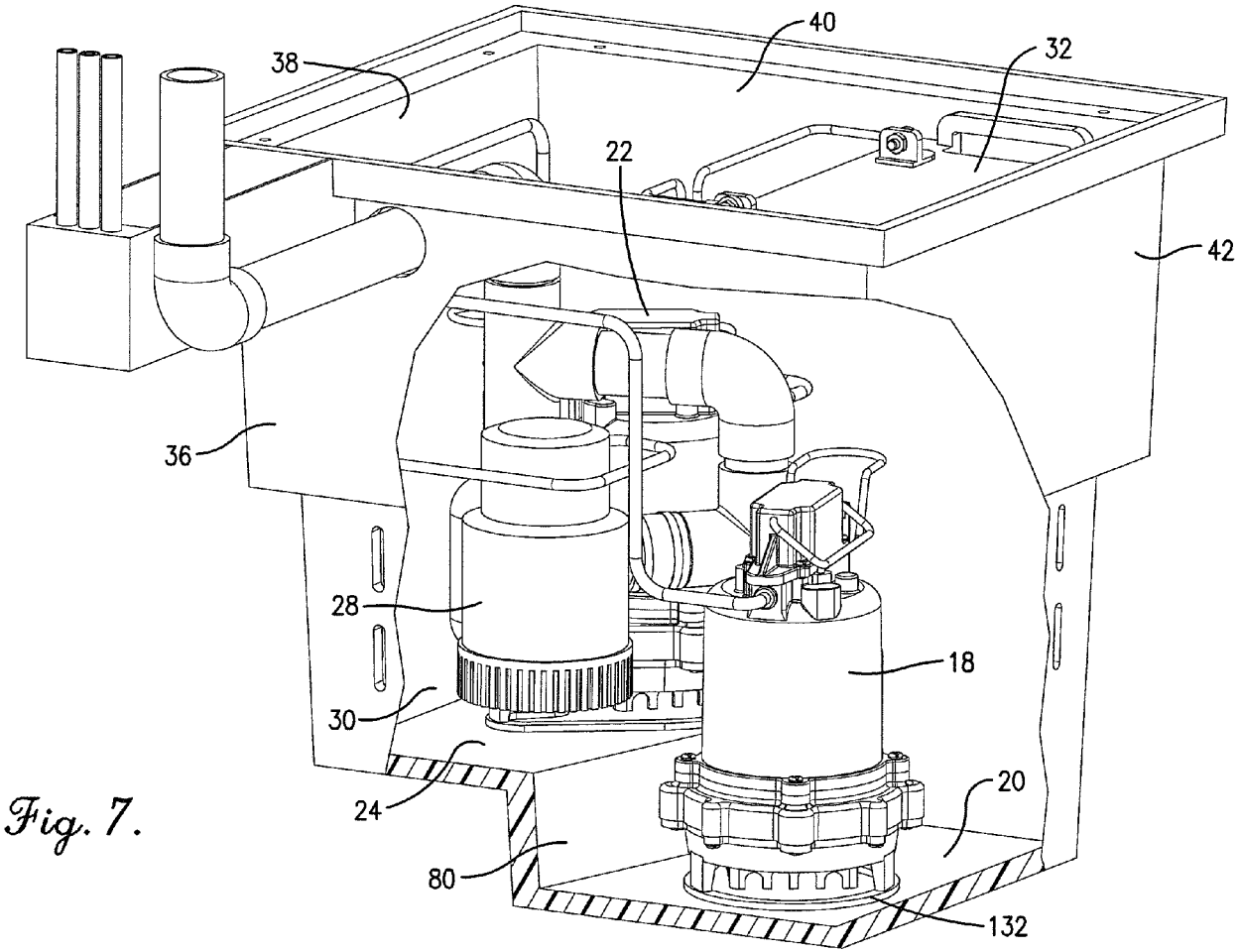
FIG. 7 is a fragmentary perspective view of the assembly of FIG. 6.
Figure 8:
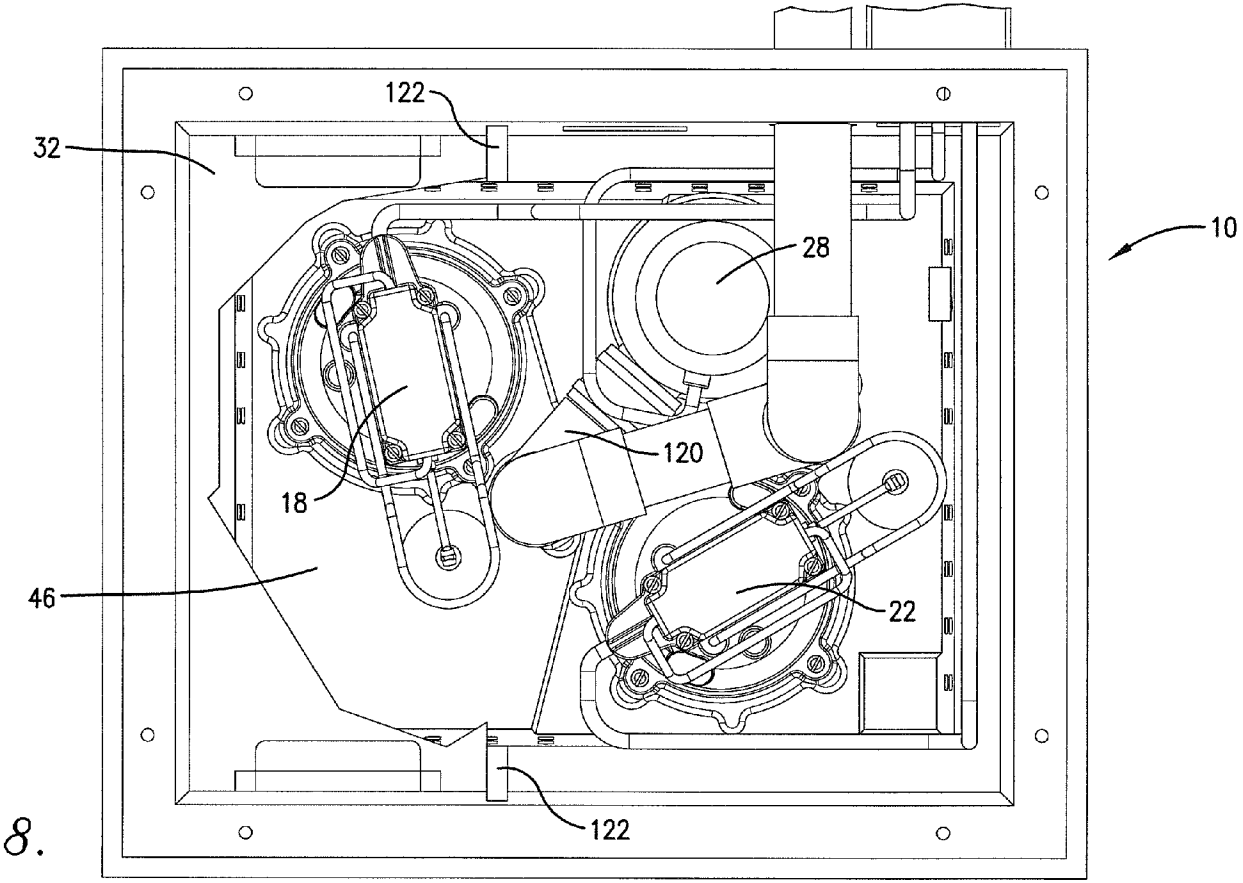
FIG. 8 is a fragmentary plan view of the assembly of FIG. 6.

Referring to FIGS. 6-8, the second embodiment of the present invention is illustrated. The second embodiment is substantially similar to the first embodiment, except that the second embodiment employs the third, battery-operated pump 28 and associated battery 32. Unlike the prior art, however, the battery 32 for the third pump 28 is mounted and otherwise housed within the basin 12. In referring to the second embodiment of the present invention, the same reference numerals for like features are used.

The third pump 28 is positioned in the upper end 50 of the basin 12 and rests on the second generally horizontal interior shelf 68. Because the battery-operated third pump 28 weighs significantly less than the first and second pumps 18,22 that have a cast iron housing, the second shelf 68 is sufficient to stabilize the third pump 28. The second pump 22 also includes a fluid line 120 in communication with the discharge line 56, and this fluid line 120 further assists in stabilizing and holding the third pump 28 in the basin 12.

The battery 32 for the third pump 28 is mounted within the basin 12 using the mount 34. In the embodiment of the present invention illustrated in the Figures, the mount 34 comprises a portion of the second shelf 68 and at least one internally extending longitudinal rib 122. The battery 32 is approximately 16 inches in length, 9 inches in height, and 7 inches in depth. Referring to FIG. 6, the basin 12 is preferably sized and the rib 122 is preferably located so that a rear side 124 of the battery 32 is adjacent the fourth wall 42 of the basin 12. The rib 122 extends inwardly from the third wall 40, and, in some embodiments, a second rib (not shown) extends inwardly from the first wall 36. The rear side 124 of the battery 32 rests on the second shelf 68 formed by the steps 62 of the first, third, and fourth walls 36,40,42. The rib 122 assists in preventing the battery 32 from toppling forward. Thus, the mount 34 of the present invention, in combination with the square or rectangular shaped basin 12, allows the battery 32 to be securely and removably mounted in the basin 12. It should be appreciated that the battery 32 could be mounted against another wall, such as the second wall 38.

Referring now to FIGS. 1, 3, and 7, installation of the sump pump assembly 10 will now be described. The installer of the assembly first excavates a sump pit 126 in the basement floor 114 or crawlspace of the building. As set forth above, the basin 12 has a total height of approximately 30-35 inches. The basement floor slab 114 is usually only approximately 4 inches. Therefore, the installer will need to excavate the pit 126 into the soil, gravel, and other earth underneath the basement floor 114. After the pit 126 is excavated, the basin 12 is positioned within the pit 126, and the pit 126 is backfilled with gravel up to approximately 4-6 inches from the top of the basin 12.

The installer next positions the first pump 18. As noted above, the first pump 18 is positioned at the lower elevation 20, which will usually be the floor 44 of the basin 12 but may be a third shelf positioned proximate to the basin floor 44. Due to the first shelf 52 fixedly secured in the basin 12, the first pump 18 is securely positioned on the basin floor 44, such that it is not encumbered by other components of the assembly 10. The installer then positions the second pump 22 on the first shelf 52. Again, due to the size and location of the first shelf 52, the second pump 22 is securely positioned within the basin 12 and will not be subject to being dislodged or moved so that it is encumbered by other components in the basin 12 or the basin walls 36-42.

In alternative embodiments of the present invention, the first and second pumps 18,22 can be further secured into position within the basin 12 and prevented from moving or becoming dislodged via installation of a non-skid, shock absorbing buffer 132 located on a bottom 134 of the pumps 18,22. Referring to FIGS. 5-6, the conventional pumps 18,22 include a base 136 having feet 138 thereon, and it is the feet 138 that contact the basin floor 44 or first shelf 52. As noted above, once water enters the basin 12, the pumps 18,22 are subject to moving and becoming dislodged. Although the basin shape of the present invention assists in preventing movement of the pumps 18,22, the buffer 132 further assists in preventing even very small (i.e., less than 0.5-1 inch) displacement of the pumps 18,22. The buffer 132 also further assists in absorbing the shock and vibration of the pumps 18,22 due to the pump motors.

The buffer 132 of the present invention is preferably a line of rubber or other non-skid, shock absorbing material. The buffer's vertical cross sectional shape may be generally circular, oblong, rectangular, or any other shape. The buffer 132 is preferably approximately ⅛-3⁄16 inch thick and approximately 10-25 inches long, as needed. The buffer 132 is preferably slightly rigid so that it can be laid out in the shape of the pump bottom 134. In an even further preferable form, the buffer 132 is manufactured to mimic the shape of the bottom 134 of the respective pump 18,22 and maintain that shape for placement in the basin 12. The buffer 132 is then secured to the basin 12 using adhesive and/or a nylon fastener, such as a plastic anchor, screw, bolt, or rivet (not shown). Due to the weight of the respective pump 18,22, the feet 138 of the pump 18,22 will press into the rubber buffer 132 so as to further assist in preventing movement of the pump 18,22.

The buffer 132 may alternatively be a series of rubber pieces (not shown) positioned where the feet 138 will stand relative to the basin 12. Thus, the buffer 132 need not be a unitary line. In such an instance, each rubber piece would be secured to the basin 12. However, the buffer 132 formed in the shape of the pump bottom 134 assists in installing the pump 18,22, as the installer can position the buffer 132 in the basin 12 first and know that the respective pump 18,22 will be located directly on top of the buffer 132. Due to the sizing of the basin 12 of the present invention, the pumps 18,22 can usually only be positioned in the basin 12 in one orientation. Use of the buffer 132 allows the installer to see the orientation and footprint of the pump prior to installation of the pumps.

After installing the buffer and the pumps, the discharge line 56 is installed. The discharge line 56 comprises a conventional PVC pipe or other suitable conduit. Unlike the prior art where two discharge lines are used for the respective first and second pumps 18,22, the present invention employs a single discharge line for both pumps 18,22.

If the second embodiment of the present invention is being installed, the installer will also install the third pump 28 and the battery 32. The battery 32 is mounted within the basin 12 using the mount 34, which comprises a portion of the second shelf 68 and the longitudinal rib 122. The basin 12 is sized to receive the battery 32 between opposing walls. In particular, the battery 32 is sized to fit laterally between the first and third walls 36,40, as best illustrated in FIGS. 6 and 7. The rear side 124 of the battery 32 would then be adjacent to and in contact with the fourth wall 42. A bottom edge 128 of the left and right sides and rear side 124 of the battery 32 rests on the second shelf 68. The longitudinal rib 122 is spaced so that it catches a front side of the battery 32 should the battery 32 begin to topple forward.

As noted above, the installer will form the first and second openings 54,58 in the basin 12 using the markers as guidance. The discharge line 56 will extend through the first opening 54 and connect with an external conduit 130 that carries the water to a location external to the building. Similarly, the wiring 60 for the first and second pumps 18,22 will connect with the external wire chase 90. The wire chase 90 is a metal or plastic housing for the wiring 60 that includes a cover for accessing the wiring 60. When installed, the external conduit 130 in fluid communication with the discharge line 56 will be below the basement floor slab 114. In contrast, the wire chase 90 is positioned next to and above the conduit 130, such that the slab 114 will be poured or otherwise excavated to house the wire chase 90. The chase 90 will then be generally flush with the top of the floor slab 114.

Figure 2:
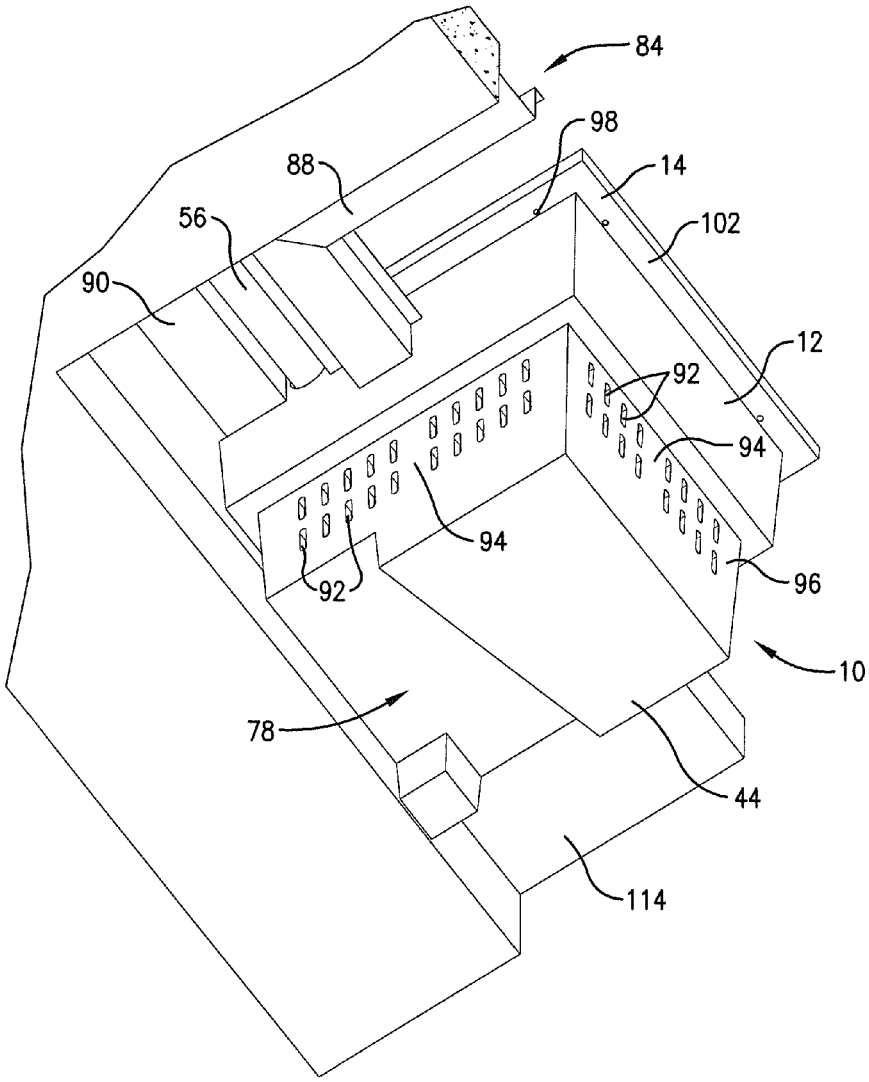
FIG. 2 is a rear perspective view of the sump pump assembly of FIG. 1 and particularly illustrating a bottom of a basin of the assembly.

If the sump pump assembly 10 is connected with the water diverting system 84, the installer will also form the third opening 86 in the upper end 50 of the basin 12 for connecting with the system 84, as illustrated in FIGS. 2 and 3.

Thus, once all components are installed, the battery 32 is located directly above the first pump 18. The second pump 22 is generally across from the first pump 18 and vertically higher than the first pump 18, and the third pump 28 is positioned above the first and second pumps 18,22, such that the pumps 18,22,28 are arranged in a generally triangular shape within the basin 12.

In operation, the basin 12 will fill with water, and the first pump 18 will operate to discharge the water from the basin 12. Should the first pump 18 cease operating, the water level will rise above the first pump's activation elevation and set off the alarm 26, which is positioned immediately above the first pump's activation elevation and, in all instances, below the second pump's activation elevation.

Although the invention has been described with reference to the embodiments illustrated in the attached drawing figures, it is noted that equivalents may be employed and substitutions made herein without departing from the scope of the invention as recited in the claims. For example, the first and second pumps 18,22 could have different horsepowers, such as ⅓ HP and ½ HP, and separate discharge lines for handling a larger volume of water.

Having thus described various embodiments of the invention, what is claimed as new and desired to be protected by Letters Patent includes the following:

1. A sump pump assembly comprising:

a basin having a floor and presenting an interior, said basin having a lower end contained by the floor and an open upper end, said basin presenting a first, lower elevation, said basin further including a first generally horizontal interior shelf spaced above the basin floor and positioned within the basin interior, said first shelf presenting a second elevation in the basin, wherein said second elevation is above said first, lower elevation;

a lid covering at least a portion of the open upper end of the basin, said lid having a transparent portion for viewing a water level in the basin without removal of the lid from the upper end of the basin;

a selectively-powered light mounted within the basin for illuminating the interior of the basin, said light including an input external to the basin;

a first submersible pump for positioning at the first, lower elevation in the basin;

a second submersible pump for positioning on the first shelf, said second pump having an activation elevation at which the second pump is activated due to the water level in the basin being at approximately the activation elevation;

an alarm having a sensor positioned within the basin and below the activation elevation of the second pump, such that the alarm is activated upon the water level in the basin rising to a level below the activation elevation for the second pump;

a battery-powered third pump for installation in the basin;

a removable battery for powering the third pump; and a mount for mounting the removable battery in the basin.

2. The assembly of claim 1, wherein the first and second pumps are float-activated pumps.

3. The assembly of claim 1, wherein the first, lower elevation is the basin floor, and the first pump is positioned on the basin floor.

4. The assembly of claim 3, wherein the first shelf is positioned at least 3 inches above the basin floor.

5. The assembly of claim 4, wherein the first interior shelf has a horizontal area equal to or less than half the area of the lower end of the basin.

6. The assembly of claim 1, wherein the first, lower elevation is within approximately 4 inches above the basin floor.

7. The assembly of claim 6, wherein the first interior shelf is positioned within 2-5 inches above the first, lower elevation.

8. The assembly of claim 1, wherein the sensor for the alarm is position within 0.25-5 inches above an activation elevation for the first pump.

9. The assembly of claim 1, said basin having first, second, third, and fourth walls so as to present a generally square or rectangular perimeter shape.

10. The assembly of claim 9, further including a plurality of perforations in each of said walls, wherein said perforations are formed in a lower end of the basin.

11. The assembly of claim 9, wherein the mount is a second horizontal interior shelf extending inwardly from at least a portion of the basin walls, said second shelf presenting a third, upper elevation.

12. The assembly of claim 11, wherein the basin is molded to form the first and second shelves.

13. The assembly of claim 12, wherein the mount further includes a rib extending vertically from one of said basin walls to removably secure the battery inside the basin.

14. The assembly of claim 1, further including first and second rubber buffers each presenting a unitary line in a general shape of a respective footprint of the first and second pumps, said buffers being configured for securement to the basin and for receipt of a bottom of the respective pump thereon, said buffers assisting in prevention of movement of the respective pump.

15. A sump pump assembly comprising:

a basin having first, second, third, and fourth walls and a floor so as to present an interior and a generally square or rectangular perimeter shape, said basin having a lower end contained by the floor and an open upper end, said basin presenting a lower elevation, said basin further including a first generally horizontal interior shelf spaced above the basin floor and fixedly positioned within the basin interior, said first shelf presenting a midrange elevation in the basin, wherein said midrange elevation is above said lower elevation;

a lid removably secured to the open upper end of the basin, said lid having a transparent for viewing a water level in the basin without removal of the lid from the upper end of the basin;

a selectively-powered light mounted within the basin for illuminating the interior of the basin, said light including an input external to the basin;

a first submersible pump for positioning at the lower elevation in the basin;

a second submersible pump for positioning on the first shelf, said second pump having an activation elevation at which the second pump is activated due to the water level in the basin being at approximately the activation elevation;

an alarm having a sensor positioned within the basin and below the activation elevation of the second pump, such that the alarm is activated upon the water level in the basin rising to a level below the activation elevation for the second pump;

a third submersible pump for positioning at an upper elevation in the basin, said third pump being battery powered;

a battery for powering the third pump; and a mount at least partially located within the interior of the basin for mounting the battery in the interior of the basin.

16. The assembly of claim 15, wherein the lower elevation is the basin floor, the first pump is positioned on the basin floor, and the first shelf is positioned 3-5 inches above the basin floor.

17. The assembly of claim 15, wherein the mount comprises an internally extending second shelf for receipt of at least a portion of the battery thereon.

18. The assembly of claim 17, wherein the battery is mounted within the basin such that a rear side of the battery is adjacent to one of the walls.

19. The assembly of claim 18, wherein the mount further includes at least one longitudinal rib located on a wall adjacent the wall to which the rear side of the battery is adjacent, and wherein the rib prevents the battery from toppling forward when placed on the second shelf.

* * * * *